US006953104B2

(12) United States Patent
Monson et al.

(10) Patent No.: US 6,953,104 B2
(45) Date of Patent: Oct. 11, 2005

(54) MUFFIN FAN HUSH HOOD

(75) Inventors: Robert James Monson, St. Paul, MN (US); Jianhua Yan, Prior Lake, MN (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/409,360

(22) Filed: Apr. 9, 2003

(65) Prior Publication Data

US 2004/0200664 A1 Oct. 14, 2004

(51) Int. Cl.[7] ..... E04F 17/04; F01N 1/02; G10K 11/02; G10K 11/16; F24F 13/24

(52) U.S. Cl. ..... 181/224; 181/225; 181/281; 181/205; 454/262; 454/906; 454/206

(58) Field of Search ..... 181/205, 224, 181/225, 217, 233, 234, 235, 238, 220, 221, 259, 260, 264, 265, 268, 278, 281, 282; 454/262, 906, 206, 346, 347; 165/154, 159, 161

(56) References Cited

U.S. PATENT DOCUMENTS

| | | | | | |
|---|---|---|---|---|---|
| 792,804 | A | * | 6/1905 | Williams | 181/265 |
| 1,246,196 | A | * | 11/1917 | Weisberg | 181/268 |
| 1,280,386 | A | * | 10/1918 | Buehner | 181/238 |
| 1,317,858 | A | * | 10/1919 | Brown | 181/265 |
| 1,938,800 | A | * | 12/1933 | Bourne | 454/206 |
| 2,147,311 | A | * | 2/1939 | Nash | 181/233 |
| 2,928,491 | A | * | 3/1960 | Crouch | 181/269 |
| 3,704,763 | A | * | 12/1972 | Becker et al. | 181/268 |
| 3,800,910 | A | * | 4/1974 | Rose | 181/229 |
| 4,165,798 | A | * | 8/1979 | Martinez | 181/268 |
| 4,334,588 | A | * | 6/1982 | Tezuka et al. | 180/68.6 |
| 4,450,933 | A | * | 5/1984 | Fukuoka et al. | 181/229 |
| 5,046,977 | A | * | 9/1991 | Rodskier | 440/89 R |
| 6,041,890 | A | * | 3/2000 | Wolf et al. | 181/230 |
| 6,488,482 | B1 | * | 12/2002 | Yannascoli et al. | 417/312 |

FOREIGN PATENT DOCUMENTS

| | | | | |
|---|---|---|---|---|
| JP | 58156135 | A | * 9/1983 | F24F/7/013 |
| JP | 62059325 | A | * 3/1987 | F24F/7/02 |

* cited by examiner

*Primary Examiner*—Edgardo San Martin

(57) ABSTRACT

A low noise method and apparatus with the apparatus including a hood for mounting over an exhaust outlet duct to capture a fluid stream and then redirect the fluid stream to a fluid outlet in the hood through the use of smoothly curving duct that maintains the fluid flowing therethrough in a laminar flow condition with the inlet and outlet positioned such that there is no line of sight between the exhaust outlet duct and the fluid outlet duct in the hood.

22 Claims, 4 Drawing Sheets

FIG. 1
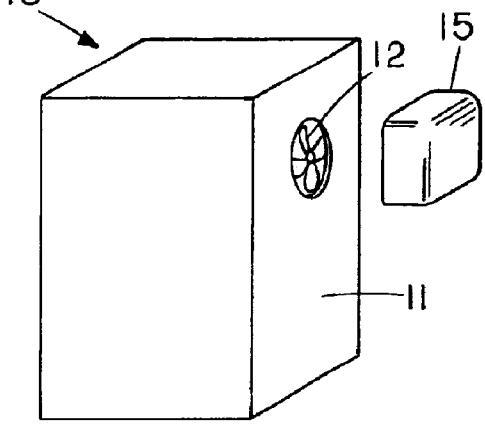
FIG. 1A
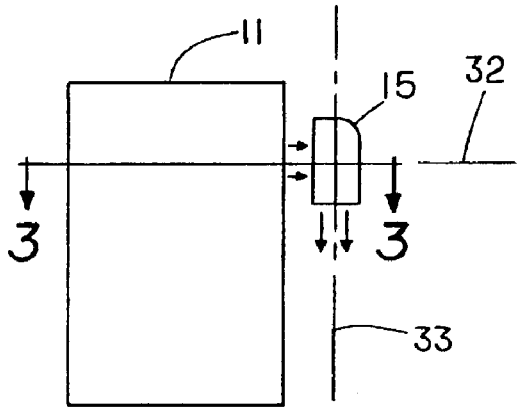
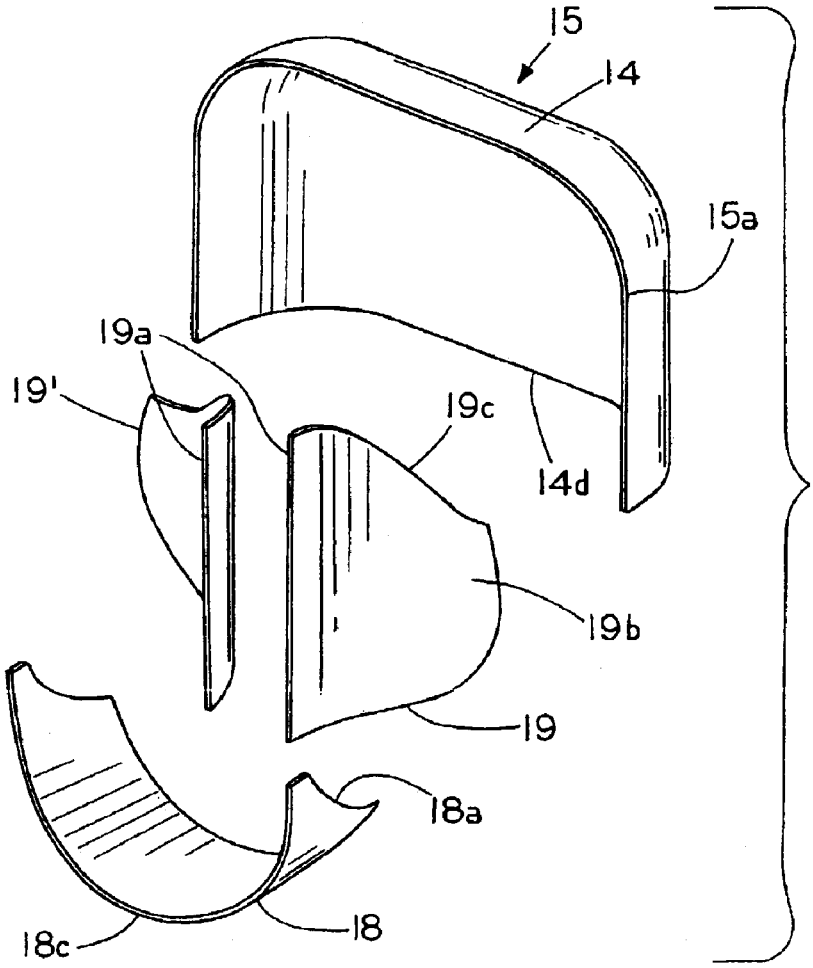
FIG. 2

MUFFIN FAN HUSH HOOD

FIELD OF THE INVENTION

This invention relates generally to noise abatement and more specifically to a noise abatement device and a method for reducing the noise of a fluid stream by preventing noise from occurring.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

One of the annoyances with fluid transfer devices and particularly with exhaust fans that are used to cool equipment is that audible noise is generated by the fan moving the air as well as by the air flowing through a discharge duct. Generally, equipment cabinets or other type apparatus have exhaust fans that direct the fluid stream directly away from the cabinet without regard to noise generation even though sound absorbing materials are often used to absorb fluid noise. The present invention comprises a hood that can be mounted on the discharge duct of existing equipment to capture a fluid stream and through a process of smoothly redirect the fluid stream so that a sound wave can only travel from the inlet to the outlet by passing through the fluid stream where maintaining the fluid stream in a laminar flow condition as it flows from an inlet to the outlet. Through the process of controlling the flow state and the positioning of the inlet and outlet ducts the generation of noise due to turbulence and sound waves is inhibited by the hood thus minimizing the need for sound absorbing materials.

SUMMARY OF THE INVENTION

Briefly, the present invention comprise a hood for mounting over a fan exhaust outlet duct to capture a fluid stream and then redirect the fluid stream to a fluid outlet in the hood with the inlet and outlet positioned such that there is no line of sight between the exhaust outlet duct and the fluid outlet duct in the hood through the use of a smoothly curving duct that maintains the fluid flowing therethrough in a laminar flow condition.

BRIEF DESCRIPTION OF THE DRAWINGS

FIG. 1 is an exploded view of an equipment cabinet and a low noise hood for mounting over the exhaust fan outlet;

FIG. 1A is a side view of the equipment cabinet and low noise hood shown in FIG. 1 to reveal the redirection of the fluid stream as it passes through the low noise hood;

FIG. 2 is an exploded view showing the fluid deflecting surfaces of the low noise hood;

DESCRIPTION OF THE PREFERRED EMBODIMENT

Figure 2A:
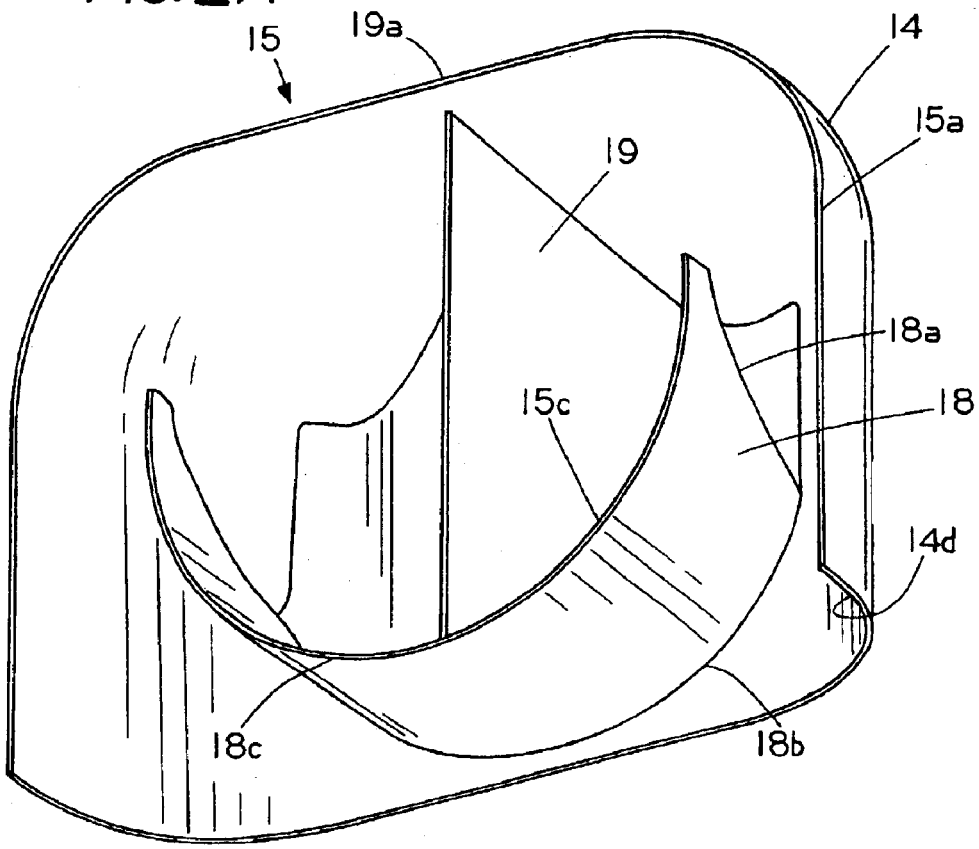
FIG. 2A is a perspective view showing the fluid deflecting surfaces of FIG. 2 in the assembled condition.

FIG. 1 is a perspective and exploded view of a system 10 having a cabinet 11 with a muffin type discharge fan 12 for directing air out of the cabinet. Positioned in a spaced and yet unattached condition is the low noise hood 15 of the present invention. While shown in an air system the hood can also be used in other fluid environments including liquids and gases. Hood 15 is preferably formed of metal but other rigid materials could be used.

FIG. 1A is a side view of the cabinet 11 and the hood 15 to illustrate the change in fluid flow direction of the fluid as it passes through the hood. As indicated by the arrows, fluid flows laterally away from cabinet 11 along axis 32 and is then redirected by hood 15 so that the fluid stream discharges downward along axis 33 though a fluid outlet in the hood 15. The fluid outlet is positioned with respect to a fluid inlet to the hood 15 so as to preclude a line of sight from fluid inlet to fluid outlet.

FIG. 2 is an exploded perspective view of hood 15 illustrating the hood exterior shell 14 having a frontal edge 15*a* for abutting against a cabinet or the like. Securable to the interior back surface 14*d* of shell 14 is a first lateral deflector 19 and a second lateral deflector 19'. Fluid deflector 19 and 19' are joined to each other by a flow edge divider 19*a*. Located below lateral deflector 19 and 19' is a radial fluid deflector 18 having a frontal edge 18*c*. In the embodiment shown frontal edge 18*c*, frontal divider edge 19*a* and frontal edge 15*a* are located in the same plane for flush mounting of the hood on a cabinet or the like. In the embodiment shown the hood 15 consists of three deflector members 19, 19' and 18 that are secured to an interior surface 14*d* of the hood 15 through welding or the like.

FIG. 2A shows a perspective view of hood 15 with the components secured to the back surface 14*d* of hood 15. As can be seen in FIG. 2A the divider 19*a* divides the hood into two symmetrical halves. In operation of the hood, half of the fluid flows along one side of divider 19*a* and the other half flows along the opposite side of divider 19*a*. Since the flow pattern and the components of each half are identical only one half of the flow duct will be described. As FIG. 2A illustrates the radial fluid deflector 18 and the two lateral fluid deflectors 19 and 19' are located within the shell 14 to provide for a flow passage from the center of hood 15 to a discharge port on the open end of duct 15.

Figure 2B:
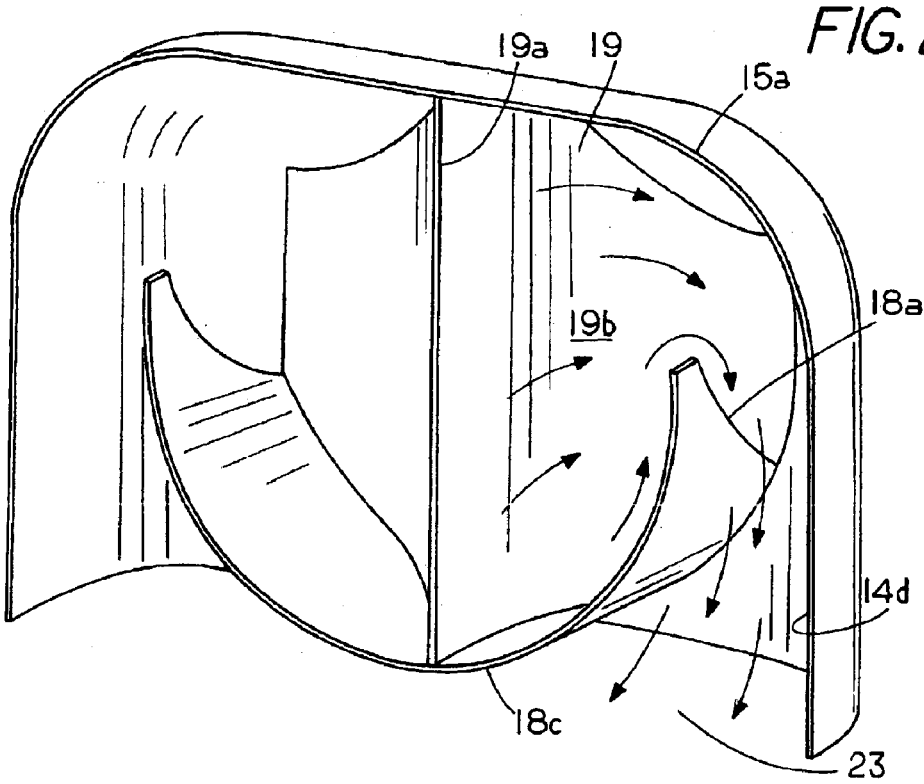
FIG. 2*b* is a perspective view shown the fluid flow patterns through the low noise hood.

FIG. 2B shows a perspective view of hood 15 with arrows included to show the flow path though the fluid duct within hood 15. That is a portion of the fluid enters hood 15 and flows along deflector surface 19*b* until it engages back surface 14*d*. A further portion is deflected circumferentially upward by surface 18*c* of radial fluid deflector 18. As the fluid is forced to the back surface 14*d* it flows over flow lip 18*a* and is entrained by the fluid stream flowing down along back surface 14*d* and surface 18*c* until the fluid discharges through an outlet passage 23 at the open end of hood 15. In the embodiment shown a fluid duct connects the inlet to the fluid outlet with the fluid duct having a cross sectional area substantially equal to or greater than the inlet area so that if a laminar flow condition exists at the fluid inlet the laminar flow condition will be maintained throughout the fluid duct.

FIG. 2B shows the fluid flowing along surface 19*b* is rotated though 90 degrees to the outlet of the fan as the lower portion of the steam is directed upward by means of the curved deflector surface 18*c*. The upward directed fluid is directed into the portion of the fluid stream passing through the top portion of the fluid duct where the stream is directed downward by the curved shell surface 14*d*. As the stream escapes downward the cross sectional flow area increases as shown in FIG. 2B to thereby slow the flow of fluid and further reduce the noise.

Figure 3:
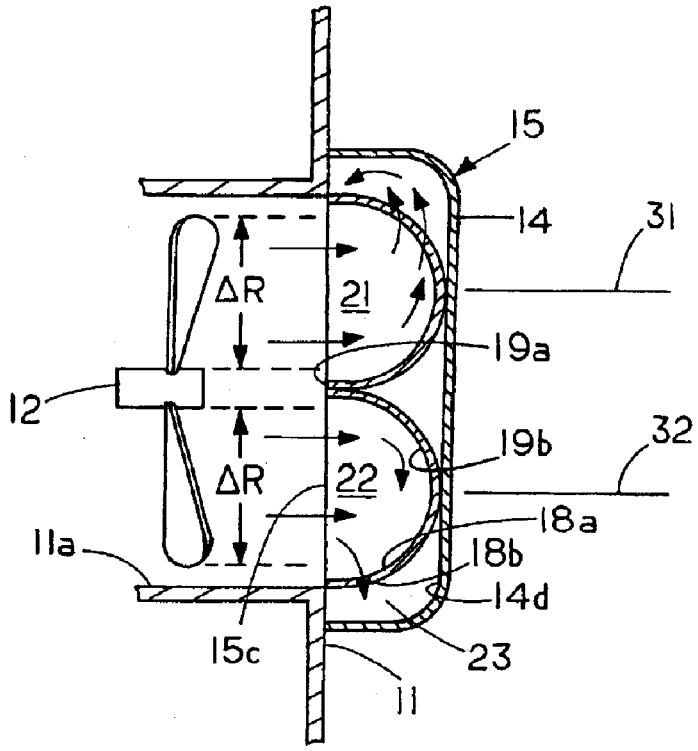
FIG. 3 is a cross sectional view taken along lines 3—3 of FIG. 2 showing a portion of the interior flow duct of the low noise hood mounted proximate an exhaust duct.

FIG. 3 shows a section view illustrating fan 12 mounted in an exhaust duct 11*a* in cabinet 11. Typically, in operation of a muffin type fan 12 the flow of fluid has a velocity profile with a low flow velocity and a low flow rate at the portion directly behind the hub of fan 12 and at the peripheral area beyond the fan blades. To indicate the primary flow region an annular region ΔR of the primary fluid flow is identified by dashed lines. As can be seen in FIG. 3 the flow arrows represent fluid flowing directly into the chambers 21 and 22. With flow divider 19*a* centrally positioned half the fluid flows into chamber 21 and the other half into chamber 22. As fluid enters the chamber22 the lateral deflector surface 19*b* and back surface 14*d* rotate the fluid flow around a 90-degree bend. As the fluid flows toward the back surface a the fluid is also forced to flow over fluid lip 18*a* and down into an outlet passage 23 formed by the back surface 14*d*, the cabinet wall 11 and the deflector surface 18*b*.

Figure 4:
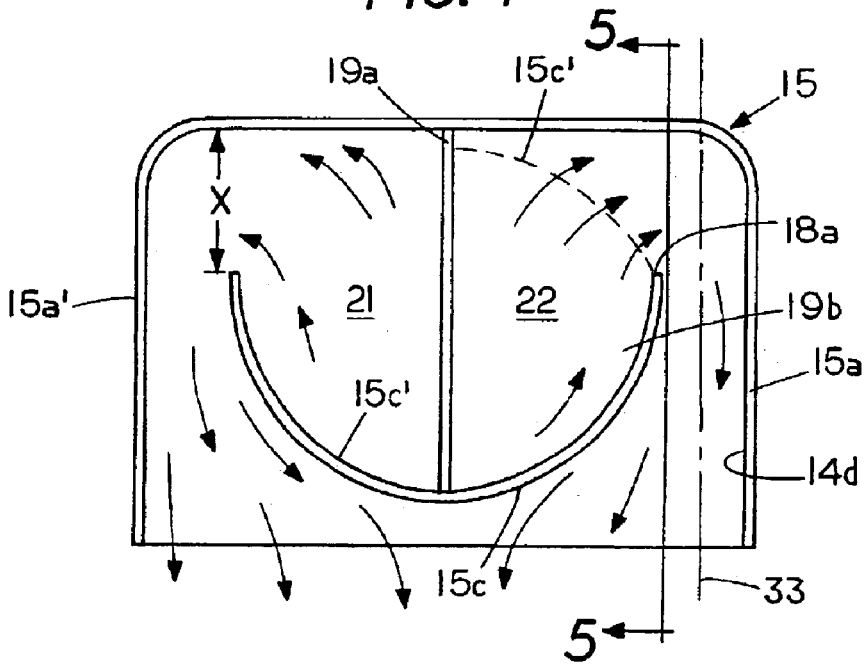
FIG. 4 is a front view of the low noise hood.

FIG. 4 is a back view of hood 15 illustrating the fluid flow in the fluid ducts therein. As can be seen in FIG. 4 half the fluid flows into chamber 22 and the other half flows into chamber 21. The half that flows into chamber 22 flows upward and around lip 18*a* and then discharges along axis 33. In the sizing of the flow duct in hood 15 the interior passages for fluid have a cross sectional area wherein the flow area within the flow duct in hood 15 is about the same or larger than the inlet area. The inlet area being defined by the edge 15*c* and the dashed line 15*c*'. That is part of the deflection surface for the fluid is determined by the deflectors within the other but other portions of the fluid utilized fluid boundaries that are produced by use of laminar flow. In operation of the present system the fluid velocity through the flow duct in hood 15 is maintained at sufficiently low level so that a laminar flow conditions exists throughout the flow duct in hood 15. In the present invention the laminar flow is maintained by having the cross sectional area of the flow duct approximately equal to or larger than the flow area of the fluid entering the duct.

The concept of laminar and turbulent flow is known in the art. Generally, when the ratio of inertia to viscous forces is below a critical level the flow is laminar and when the ratio of inertia to viscous forces is above a critical level the flow is turbulent. The critical level is often referred to as the Reynolds number. The critical Reynolds number, where laminar flow becomes turbulent flow, can vary with conditions of the passageway. In some instance laminar flow can be maintained up to Reynolds numbers in excess of 2000 and in other cases laminar flow can be maintained only if the Reynolds number is less than 1000. In addition to the laminar flow condition and turbulent flow condition there exists an intermediate condition known as "slug flow". Slug flow occurs when the flow alternates between laminar and turbulent flow. Turbulent flow and "slug flow" generally have pressure variations associated with the flow conditions. It should be understood that a reference to critical Reynolds number herein is meant to denote the Reynolds number where either "slug flow" or turbulent flow begins to occur.

Thus one aspect of the low noise hood 15 is the use of fluid duct that is sized so as to maintain a laminar flow condition throughout the flow duct. A further feature of the noise reduction of the hood 15 is that no straight-line of sight is allowed between the inlet and the outlet to ensure that no sound waves are allowed to enter the hood without having to pass through the laminar fluid stream. As a result the hood 15 is quite because the flow is maintained in a laminar flow condition.

Figure 5:
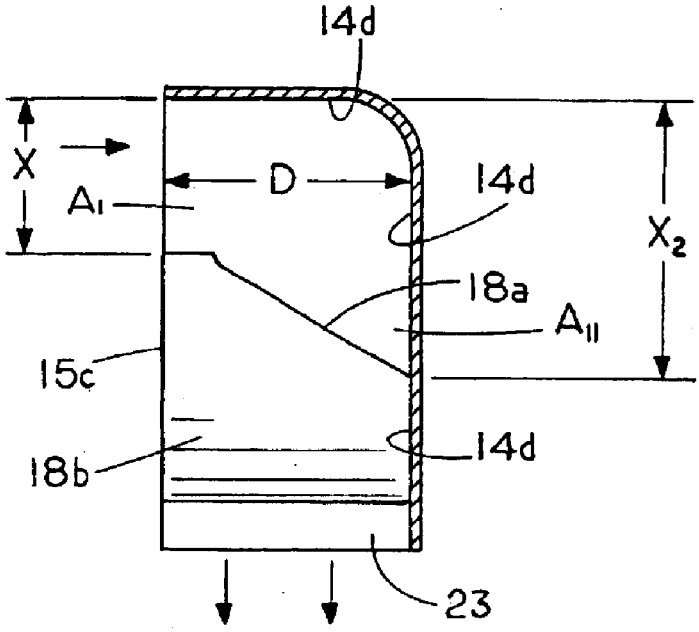
FIG. 5 is a sectional view taken along lines 5—5 of FIG. 4.

FIG. 5 shows a cross sectional view of hood 15 showing a cross sectional area $A_1$ where the fluid flows over lip 18*a* and eventually out the outlet passage 23. The cross sectional fluid area is denoted as having a height x which varies from side to side and a width D. In the embodiment shown the fluid can follow a path that is not fully defined by a rigid duct wall. That is, if a laminar flow condition exists and the cross sectional area is sufficiently large one can have a virtual sidewall defining a portion of the flow cross sectional area since laminar fluid flow can flow past a stagnate fluid region without inducing turbulence.

Figure 6:
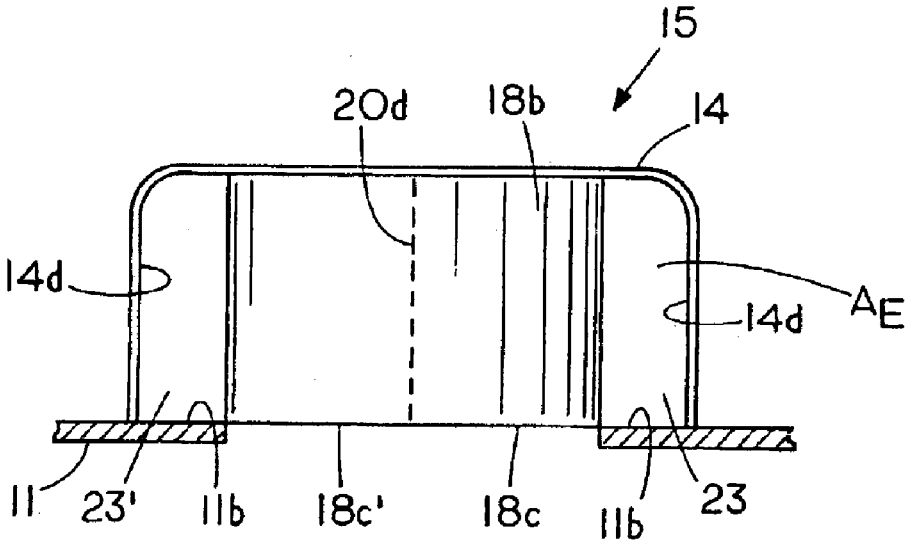
FIG. 6 is a bottom view showing of the low noise hood of FIG. 1.

FIG. 6 shows a bottom view of hood 15 showing the exhaust passage 23 formed partially by wall 11*b*, partially by shell wall 14*d* and partially by deflector surface 18*c*. Similarly, the opposite side includes a discharge passage 23' which is partial 23 formed partially by wall 11*b*', partially by shell wall 14*d* and partially by deflector surface 18*c*'.

One of the techniques of the present invention is to maintain a consistent airflow velocity though the fluid duct, which will not increase the noise. In the event that the outlet or an area within the duct is greater than the duct inlet, there will typically be a reduction in noise generated. In the preferred implementation the flow duct has a larger cross sectional flow area within the duct than at either end of the duct inlet or the duct outlet to help reduce the noise generated by the flowing air. The other technique is to provide a smooth flow path that is free of obstructions and can smoothly rotate the stream instead of forcing the stream to strike an abrupt change in profile resulting in a forced change in flow. For, example, when air leaves the outlet of the fan, it enters the inlet for the duct. The largest area for potential turbulence is typically in the center of the fan region, and thus in the present method the air stream is split to quickly reduce the interactions of any local turbulent region and dissipate any local turbulence that may be present. The split fluid stress are than rotated through 90 degrees by smoothly curved plates to ensure that the flow stream remains in a laminar condition after completing the change of direction. Thus the fluid duct includes smoothly curved plates to change the direction of a fluid flow path to thereby maintain a laminar flow condition throughout the fluid duct.

In the present embodiment the flow from an exhaust duct is split into two separate flow ducts and then redirected through the hood; however, the hood could contain a single flow duct or three or more fluid ducts as long as the fluid flow is maintained in a laminar state and as long as sound waves at the inlet to the hood must travel through the laminar flow stream. To ensure that sound waves must follow the laminar fluid stream the inlet of the hood is positioned with respect to the outlet of the hood so there is no line of sight therebetween.

Thus in the present invention includes a method of reducing the noise from an exhaust fan 12 by placing a hood inlet duct around at least a portion of a fluid stream emanating from the exhaust fan. By capturing the emanating fluid stream and redirecting the fluid stream so as to preclude a line of sight from the inlet duct to an outlet duct while restricting the velocity of the fluid stream to maintain the fluid stream in a laminar flow condition during flow from the inlet duct to the outlet duct one produces a low noise discharge system.

One of the ways of maintaining a laminar flow condition is to maintain a substantially constant flow area as the fluid flows from the inlet duct to the outlet duct and one of the ways of preventing sound waves from propagating directly from the inlet duct to the outlet duct is to direct the fluid stream at a first angle into an exhaust hood and direct the fluid at a right angle from the first angle so as to preclude a line of sight between the inlet duct and the outlet duct.

A further feature of the present method is that the hood can be mounted to a cabinet as an aftermarket device by mounting the inlet duct on an existing cabinet having a discharge fan therein.

While the method can be used to divide a fluid stream into at least two equal fluid streams the fluid stream can be divided into more or less fluid streams which may be a gaseous stream such as an air stream.

We claim:

1. A low noise hood comprising:

a fluid inlet having a fluid inlet area;

a fluid outlet, said fluid outlet having a fluid outlet area, said fluid outlet positioned with respect to said fluid inlet so as to preclude a line of sight from said fluid inlet to said fluid outlet; and a fluid duct, said fluid duct connecting said fluid inlet to said fluid outlet, said fluid duct having a cross section flow area substantially greater than an inlet area so that if a laminar flow condition exists at said fluid inlet the laminar flow condition will be maintained throughout said fluid duct.

2. The low noise hood of claim 1 wherein the fluid duct includes smoothly curved plates to change the direction of a fluid flow path to thereby maintain a laminar flow condition throughout the fluid duct.

3. The low noise hood of claim 1 wherein the fluid duct has a curved sidewall for changing a flow direction of the fluid therein without inducting turbulence therein.

4. The low noise hood of claim 3 wherein the fluid duct has an unbounded portion.

5. The low noise hood of claim 3 wherein the hood includes at least two fluid inlets with each of said inlets positioned to receive approximately half of a flow output of a fan.

6. The low noise hood of claim 3 wherein at least a portion of the curved sidewall comprises a deflector secured to an interior surface of the low noise hood.

7. The low noise hood of claim 1 wherein the low noise hood is made of metal.

8. A method of reducing the noise from an exhaust fan comprising:

placing an inlet duct around at least a portion of a fluid stream emanating from the exhaust fan;

capturing the emanating fluid stream and redirecting the fluid stream so as to preclude a line of sight from the inlet duct to an outlet duct;

restricting the velocity of the fluid stream to maintain the fluid stream in a laminar flow condition during fluid flow from said inlet duct to said outlet duct.

9. The method of claim 8 including the step of maintaining a substantially constant flow area as the fluid flows from said inlet duct to said outlet duct.

10. The method of claim 9 including the step of directing the fluid stream at a first angle into an exhaust hood and directing the fluid at a right angle from the first angle.

11. The method of claim 8 including the step of mounting the inlet duct on a cabinet having a discharge fan therein.

12. The method of claim 8 including the step of separating the fluid stream into at least two equal fluid streams.

13. The method of claim 8 wherein the step of placing a duct around fluid stream comprises placing a duct around a gaseous stream.

14. The method of claim 13 wherein the step of placing the duct around the gaseous stream comprises placing the duct around an air stream.

15. A low noise hood comprising;

a fluid inlet having a fluid inlet area;

a fluid outlet, said fluid outlet having a fluid outlet area, said fluid outlet positioned with respect to said fluid inlet so as to preclude a line of sight from said fluid inlet to aid fluid outlet; and a smoothly curved fluid duct connecting said inlet to said fluid outlet so as to maintain a laminar flow condition throughout said fluid duct.

16. The low noise hood of claim 15 wherein the fluid duct has a divider for splitting a fluid stream entering the hood to inhibit turbulence therein.

17. The low noise hood of claim 15 wherein the fluid duct has a lip defining a portion of the cross sectional area of said fluid duct.

18. The low noise hood of claim 15 wherein the hood includes at leas two fluid inlets with each of said fluid inlets positioned to receive approximately half of a flow output of a fan.

19. The low noise hood of claim 15 wherein the fluid inlet area is located at an angle of about 90 degrees from the fluid outlet through a smoothly curved passageway in said low noise hood.

20. The low noise hood of claim 15 wherein the low noise hood is made of metal.

21. The low noise hood of claim 15 wherein the hood comprises a shell having an open face for mounting over and exhaust duct.

22. The low noise hood of claim 15 wherein the hood consists of three deflector members that are secured to an interior surface of the hood.

* * * * *